US006082460A

United States Patent [19]

June

[11] Patent Number: 6,082,460

[45] Date of Patent: Jul. 4, 2000

[54] APPARATUS AND METHOD FOR CONTROLLING HYDRAULIC CONTROL FLUID CIRCUITRY FOR A TUBING HANGER

[75] Inventor: David R. June, Cypress, Tex.

[73] Assignee: Cooper Cameron Corporation, Houston, Tex.

[21] Appl. No.: 08/785,323

[22] Filed: Jan. 21, 1997

[51] Int. Cl.[7] ..... E21B 23/00

[52] U.S. Cl. ..... 166/348; 166/368; 166/89.2

[58] Field of Search ..... 166/368, 348, 166/374, 382, 89.2, 89.3, 88.2, 88.4

[56] References Cited

U.S. PATENT DOCUMENTS

| | | | |
|---|---|---|---|
| 3,739,846 | 6/1973 | Beson | 166/89 |
| 3,965,977 | 6/1976 | Beson | 166/88 |
| 4,133,378 | 1/1979 | Gano | 166/360 X |
| 4,154,298 | 5/1979 | Gano | 166/348 X |
| 4,181,175 | 1/1980 | McGee et al. | 166/85 |
| 4,219,223 | 8/1980 | Schulte | 285/26 |
| 4,333,526 | 6/1982 | Watkins | 166/87 |
| 4,364,433 | 12/1982 | Fisher et al. | 166/339 |
| 4,449,583 | 5/1984 | Lawson | 166/72 |
| 4,458,903 | 7/1984 | Tohill | 277/167.5 |
| 4,491,176 | 1/1985 | Reed | 166/65 R |
| 4,592,426 | 6/1986 | Neely | 166/347 |
| 4,607,691 | 8/1986 | Bridges | 166/88 |
| 4,616,857 | 10/1986 | Woodman et al. | 285/140 |
| 4,623,020 | 11/1986 | Nichols | 166/88 |
| 4,637,419 | 1/1987 | Hughes | 137/236.1 |
| 4,712,621 | 12/1987 | Wightman et al. | 166/348 X |
| 4,796,922 | 1/1989 | Prichard | 285/26 |
| 4,880,061 | 11/1989 | Ahlstone | 166/348 |
| 5,366,017 | 11/1994 | Voss, Jr. | 166/368 |
| 5,372,199 | 12/1994 | Cegielski et al. | 166/368 |
| 5,465,794 | 11/1995 | McConaughy et al. | 166/375 |

FOREIGN PATENT DOCUMENTS

| | | |
|---|---|---|
| 0572732A1 | 6/1992 | European Pat. Off. . |
| 2030620 | 9/1979 | United Kingdom . |
| 2161188 | 1/1986 | United Kingdom . |

*Primary Examiner*—William P. Neuder
*Attorney, Agent, or Firm*—Bush, Riddle & Jackson

[57] ABSTRACT

Wellhead completion apparatus includes a wellhead member (11) having an upper supporting shoulder (24) and a lower landing shoulder (26). A running tool (30) is releasably connected to a tubing hanger (36) for lowering and landing the tubing hanger (36) on the wellhead member (11). A fluid coupling (66, 68, 70) is provided between the running tool (30) and the tubing hanger (36). Another fluid coupling (17, 60, 84) is provided between the tubing hanger (36) and the wellhead member (11). The running tool (30) has a body (31) connected to the tubing hanger (36) and an outer sleeve (46) of the running tool (30) is adapted for initial seating on upper supporting shoulder (24) of the wellhead member (11). After the initial seating of sleeve (46) on upper supporting shoulder (24), running tool (30) and tubing hanger (36) are moved downwardly relative to external sleeve (46) for landing of the tubing hanger (36) onto the lower landing shoulder (26) of the wellhead member (11). Hydraulic fluid is provided from the running tool (30) to the tubing hanger (36) during lowering of the tubing hanger (36) as shown in FIG. 5. Upon downward movement of tubing hanger (36) after the seating of running tool sleeve (46) on upper supporting shoulder (24) the supply of fluid is transferred from the tubing hanger (30) to the wellhead member (11) as shown in FIG. 6. The auxiliary control fluid passage (62) to the running tool (30) is blocked by the wellhead ring (17) defining the lower landing shoulder (26). An embodiment shown in FIGS. 7–9 permits a wellhead ring (17A) which is secured to the wellhead member (11A) to be sealed by O-rings (76A, 78A) along planar surfaces (13A, 75A) about the control fluid passage (22A) in the wellhead member (11A).

21 Claims, 9 Drawing Sheets

APPARATUS AND METHOD FOR CONTROLLING HYDRAULIC CONTROL FLUID CIRCUITRY FOR A TUBING HANGER

FIELD OF THE INVENTION

This invention relates to an apparatus and method for controlling the hydraulic control fluid circuitry for a tubing hanger, and more particularly to such an apparatus and method in which the hydraulic control fluid circuitry for supplying hydraulic fluid through the tubing hanger to downhole control members is transferred from a running tool for lowering the tubing hanger within a wellhead member to the wellhead member which receives the tubing hanger in a landed position.

BACKGROUND OF THE INVENTION

For well completion, a tubing hanger with a tubing string thereon is releasably connected to a running tool and lowered within a well for landing on a wellhead member. Hydraulic control fluid passages in the wellhead member and the tubing hanger are aligned in the landed position of the tubing hanger for the supply of the hydraulic control fluid to the tubing hanger. Hydraulic control fluid lines normally extend from the tubing hanger to selected downhole control members such as a downhole safety valve or a downhole chemical injection member for actuation of the downhole control members. Various prior art hydraulic fluid connectors or couplings have been provided heretofore between the wellhead member and the tubing hanger for the supply of hydraulic control fluid to the tubing hanger when landed on the wellhead member. For example, U.S. Pat. No. 5,465,794 dated Nov. 14, 1995 and U.S. Pat. No. 5,555,935 dated Sep. 17, 1996 disclose such fluid connectors.

Oftentimes, it is desirable that hydraulic control fluid be supplied, or have the capability of being supplied, to certain downhole control members, such as downhole safety valves, before the tubing hanger is landed on the wellhead member and while the running tool is lowering the tubing hanger within the wellhead member. For this purpose the hydraulic control fluid circuitry extends through a running tool for the supply of hydraulic control fluid to the tubing hanger and the downhole control members. The running tool is disconnected from the tubing hanger after landing of the tubing hanger on the wellhead member and it is necessary to seal the hydraulic control fluid port in the tubing hanger adjacent the running tool so that leakage does not occur. It is also possible that heavy well fluids in the wellbore might leak into the control fluid port and the associated fluid passage if not adequately sealed off.

SUMMARY OF THE INVENTION

The present invention is particularly directed to an apparatus and method for a wellhead completion system including a running tool releasably connected to a tubing hanger for landing the tubing hanger onto a wellhead member such as a spool. Hydraulic control fluid circuitry is provided for supplying hydraulic fluid to the tubing hanger from a running tool during lowering the running tool and tubing hanger within the well, and for supplying hydraulic control fluid to the tubing hanger from the wellhead member after landing of the tubing hanger on the wellhead member while blocking the supply of control fluid from the running tool.

A main control fluid passage extends from the tubing hanger to control fluid lines to the downhole control member such as downhole safety valves. An auxiliary control fluid passage in the tubing hanger is in fluid communication with the running tool during lowering of the running tool and communicates with the main control fluid passage in the tubing hanger to provide control fluid to the tubing hanger for the downhole control member prior to landing of the tubing hanger on the wellhead member. Fluid coupling means provided between the tubing hanger and the wellhead member form an important feature of this invention. The fluid coupling means is effective during the landing of the tubing hanger on the wellhead member for blocking and sealing off the auxiliary control fluid passage in the tubing hanger from the running tool before the wellhead member and tubing hanger are in fluid communication with each other. The running tool is removed after the auxiliary control fluid passage has been sealed at the fluid coupling means for the tubing hanger and wellhead member to prevent any leakage thereat. Any well fluids entering the auxiliary control fluid passage from the running tool are blocked at the fluid coupling means. The present invention also permits the running tool to be easily reconnected to the tubing hanger with control fluid from the running tool communicating with the tubing hanger upon raising of the tubing hanger.

The hydraulic control fluid coupling means are effective to block and seal off the auxiliary fluid passage in the tubing hanger from the running tool while effecting fluid communication between a lateral port in the wellhead member with the main control fluid passage in the tubing hanger. The control fluid coupling means between the tubing hanger and the wellhead member includes a lower ring fixed to the wellhead member and an upper ring mounted on the tubing hanger for sliding movement relative to the tubing hanger. A plurality of axial openings in the rings are adapted to align vertically and a plurality of stab pins carried by the tubing hanger are received within the vertically aligned openings in the landed position of the tubing hanger. The auxiliary control fluid passage in the tubing hanger communicating with the running tool terminates at a lateral port in the tubing hanger adjacent the upper slidable ring.

Each stab pin in one embodiment has a central axial flow passage with a pair of opposed lateral ports adjacent the lower end of the central flow passage. The axial flow passage of the stab pin is in fluid communication with a control fluid line to the downhole control member for actuation thereof and forms the main control fluid passage in the tubing hanger. One of the lateral ports in the stab pin is in fluid communication with the auxiliary flow passage to the running tool as the running tool is being lowered within the wellhead member. The other opposed lateral port is in fluid communication with the control fluid supply passage in the wellhead member in the landed position of the tubing hanger but is blocked out of fluid communication during lowering of the running tool and tubing hanger within the wellhead member. The stab pin has an upper annular seal above the opposed ports and a lower annular seal below the opposed ports about the outer periphery of the stab pin. Before landing of the tubing hanger, the upper and lower seals provide sealing about a lateral port in the upper ring in fluid communication with the running tool. After landing of the tubing hanger, the upper and lower seals seal about a lateral port in the lower ring fixed to the wellhead member and the upper lateral port is blocked out of communication with the stab pin.

In another embodiment of the invention, opposed planar surfaces are provided between the wellhead member and the fixed ring which forms an integral part of the wellhead member and provides the landing shoulder for the tubing hanger. O-rings effectively seal between the opposed planar surfaces of the wellhead member and ring about the hydraulic control fluid passage from the wellhead member to the tubing hanger.

It is an object of this invention to provide an apparatus and method for controlling hydraulic control fluid circuitry for a tubing hanger in which the control fluid circuitry for supplying hydraulic fluid to the tubing hanger for control of downhole control members is transferred from the running tool to the wellhead member receiving the tubing hanger in landed position.

A further object of this invention is to provide such an apparatus and method in which hydraulic fluid coupling means are provided between the tubing hanger and the wellhead member effective to block and seal off an auxiliary fluid passage in the tubing hanger to the running tool while effecting fluid communication between the wellhead member and the tubing hanger.

Another feature to this invention is to provide a hydraulic control fluid coupling means between the tubing hanger and the wellhead member which include stabbing pins that form the main control fluid passage through the tubing hanger from the running tool and from the wellhead member.

Other objects, features, and advantages of the invention will be more apparent from the specification and drawings.

DESCRIPTION OF THE INVENTION

Embodiment of FIGS. 1–7

Figure 1A:
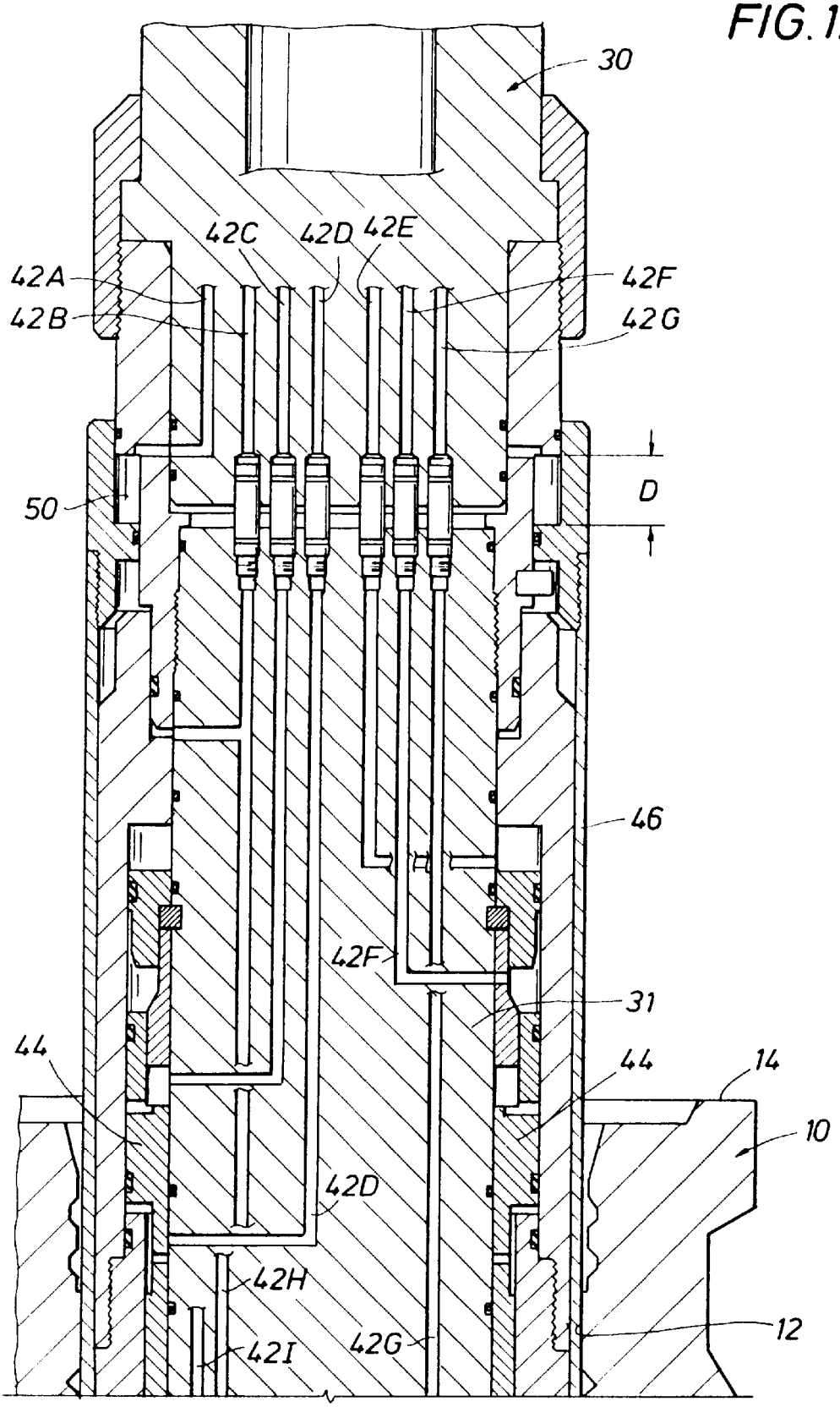
FIGS. 1A and 1B are upper and lower sectional view of a wellhead assembly including a running tool connected to a tubing hanger for landing the tubing hanger within a wellhead member while supplying hydraulic fluid from the running tool to the tubing hanger for the control of downhole control member such as downhole safety valves.
Figure 1B:
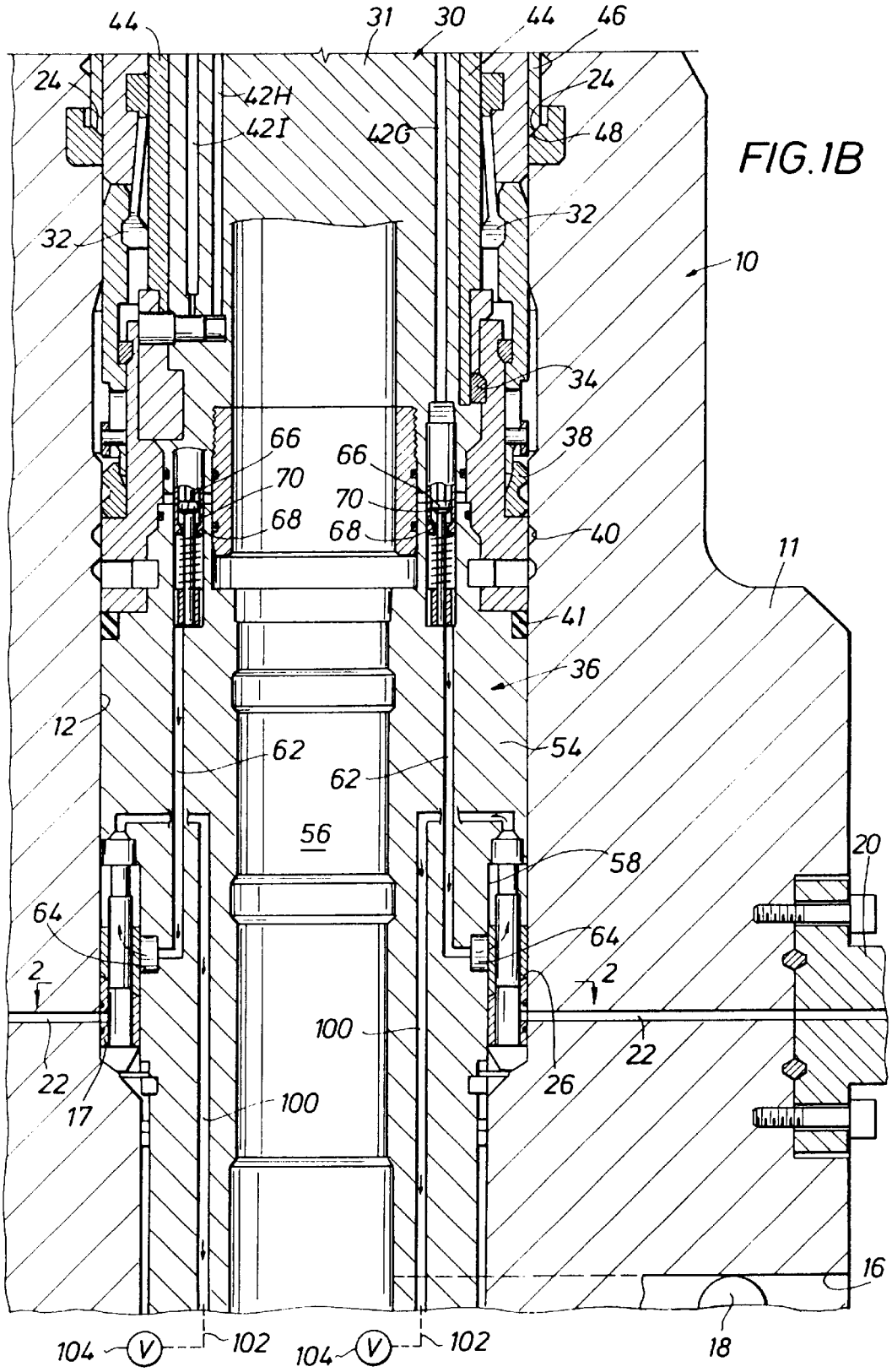

Well completion apparatus as shown in FIGS. 1A and 1B includes a production tree or wellhead structure generally indicated at 10 and having a wellhead body or spool indicated generally at 11. Wellhead body 11 has a central bore 12 and an upper end 14. A production fluid outlet is shown at 16 and a suitable valve 18 is provided to control flow from the well through outlet 16 as well known. A fitting shown at 20 is secured to body 11 and a lateral hydraulic fluid supply passage 22 extends through body 11 and fitting 20 to bore 12 of body 11. Fluid passage 22 is connected by suitable lines to a fluid source (not shown) normally at a surface location for subsea operations. A wellhead ring generally indicated as 17 is permanently secured by screws 19 to the inner peripheral surface of wellhead body 11 and forms an integral part of wellhead structure 10 as shown also in FIGS. 2 and 3. Wellhead body 11 has an upper supporting shoulder 24 and wellhead ring 17 forms a lower landing shoulder or seat 26 for wellhead body 11.

Figure 4:
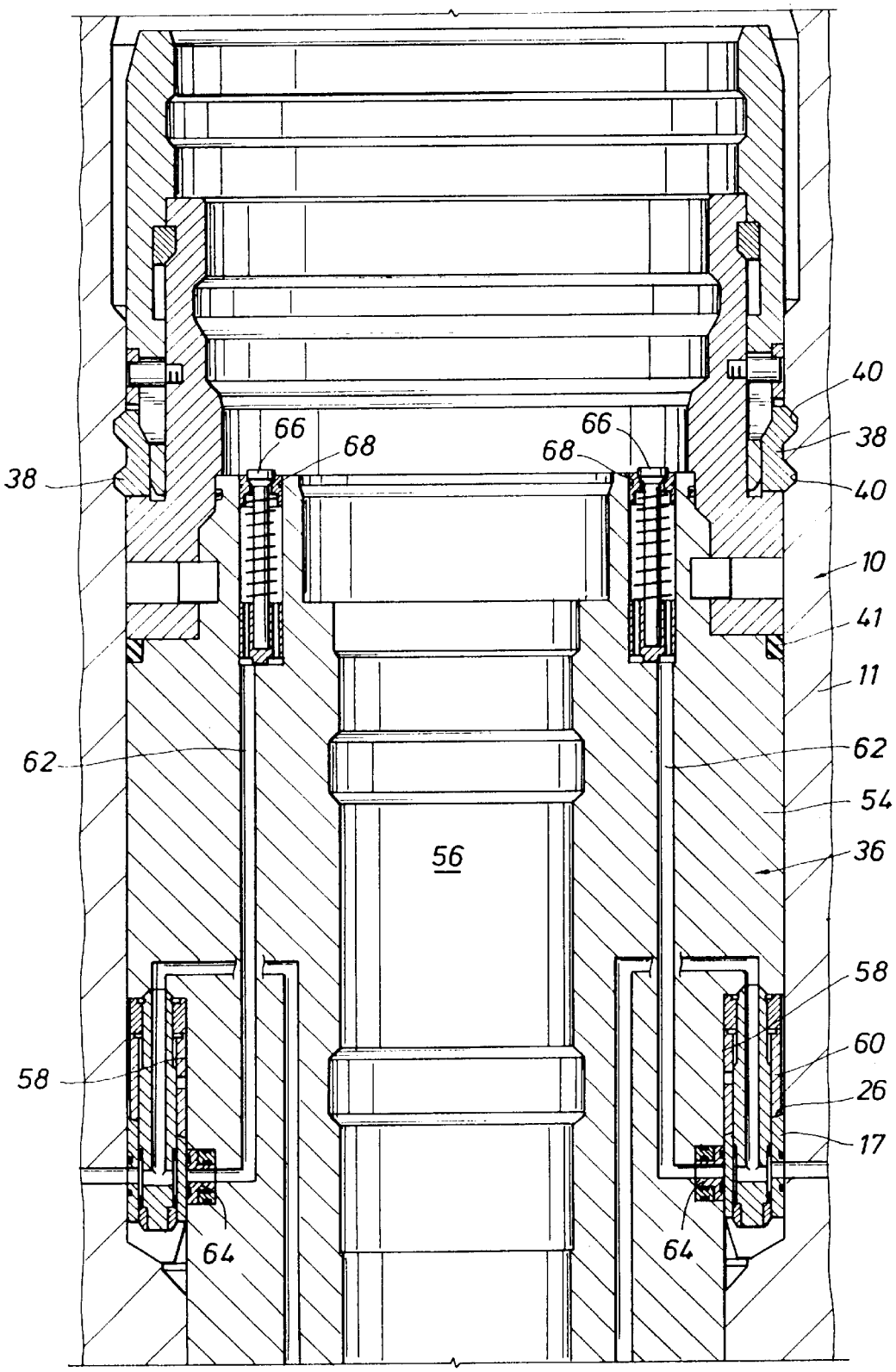
FIG. 4 is an enlarged fragment of FIG. 1B showing the running tool removed from a tubing hanger with the tubing hanger landed on the wellhead member and hydraulic fluid being supplied to the tubing hanger through the wellhead member.

A running tool is shown generally at 30 having a body 31 and is releasably connected by latches 32, 34 to the upper end of a tubing hanger shown generally at 36. Tubing hanger 36 is shown in FIG. 1B in close contact with, but prior to landing completely on annular shoulder 26 of wellhead ring 17 and releasably connected to running tool 30. Tubing hanger 36 is shown in FIG. 4 in a completely landed position on landing shoulder 26 of wellhead ring 17 with running tool 30 disconnected from tubing hanger 36 and removed from the well. A tubing string (not shown) is connected to the lower end of tubing hanger 30. In the landed position of tubing hanger 36 shown in FIG. 4, a locking ring 38 is received in annular groove 40 in the inner peripheral surface of bore 12. An annular seal 41 is provided between tubing hanger 36 and wellhead body 11.

Various downhole fluid supply functions, such as downhole safety valves for tubing strings, or downhole chemical injection, are supplied with fluid from a surface fluid source for subsea operations. It is desirable that hydraulic or liquid fluid be supplied, or have the capability of being supplied, to such downhole functions during lowering of tubing hanger 36 within the well by running tool 30. After complete landing of tubing hanger 36 on wellhead ring 17 of wellhead body 11 and before removal of running tool 30, the supply of hydraulic control fluid from running tool 30 is transferred to wellhead structure 10. For this purpose, hydraulic control fluid couplings or connectors are provided between the running tool 30 and tubing hanger 36, and between wellhead structure 10 and tubing hanger 36. Running tool 30 has a plurality of hydraulic control fluid passages or lines 42A, 42B, 42C, 42D, 42E, 42F, 42G, 42H and 42I which are in fluid communication with a fluid source, such as a reservoir. Lines 42A–42I extend to various locations requiring fluid supply. Control fluid lines 42D and 42F control the operation of piston sleeve 44 for releasably connecting running tool 30 to tubing hanger 36. Fluid is supplied through line 42F for moving piston sleeve 44 downwardly into a latched position as shown in FIGS. 1A and 1B. Fluid is supplied through line 42D for moving piston sleeve 44 upwardly into an unlatched position to permit removal of running tool 30. Running tool 30 has an outer sleeve or housing 46 having a lower shoulder 48 which is adapted to seat on annular shoulder 24 of wellhead structure 10 during lowering of tubing hanger 36 within wellhead structure 10, but before tubing hanger 36 seats or lands on annular shoulder 26 of wellhead structure 10. After initial seating of sleeve 46 on supporting seat 24, hydraulic fluid is bled from an annular fluid chamber 50 through line 42A as shown in FIG. 1A to permit relative downward movement of running tool body 31 and tubing hanger 36 a distance D of about three and one half (3½) inches until tubing hanger 36 is landed on shoulder 26 of wellhead ring 17 fixed to wellhead member 11. Thus, tubing hanger 36 is landed on wellhead structure 10 in two separate steps, one step in which outer sleeve 46 of running tool 30 seats on annular shoulder 24 of wellhead body 11, and a second step in which running tool 30 and tubing hanger 36 move downwardly relative to sleeve 46 to a landed position on shoulder 26 of ring 17.

Tubing hanger 36 has a body 54 and a central bore 56 extending axially of body 54. Body 54 has an outer annual recess 58 and a slidable hanger landing ring 60 mounted within recess 58. Hanger ring 60 has a lower seat surface 61 shown in FIG. 5A which seats on shoulder 26 of wellhead ring 17 when tubing hanger 36 is landed on wellhead housing or spool 11. Tubing hanger 36 has a plurality, such as six, axially extending auxiliary control fluid passages 62 therein in fluid communication with a plurality of separate control fluid passages 42G in running tool 30. Each passage 62 extends from the upper end of tubing hanger 36 to a fitting 64 at peripheral recess 58. A check valve shown generally at 66 is provided at the upper end of each auxiliary fluid passage 62 in which sleeve valve member 68 is biased to a closed position. As shown in FIG. 1B when running tool 30 is connected to tubing hanger 36, sleeve valve member 68 is opened by a projection 70 on running tool 30 to permit control fluid flow to auxiliary fluid passage 62 from passage 42G.

Figure 5:
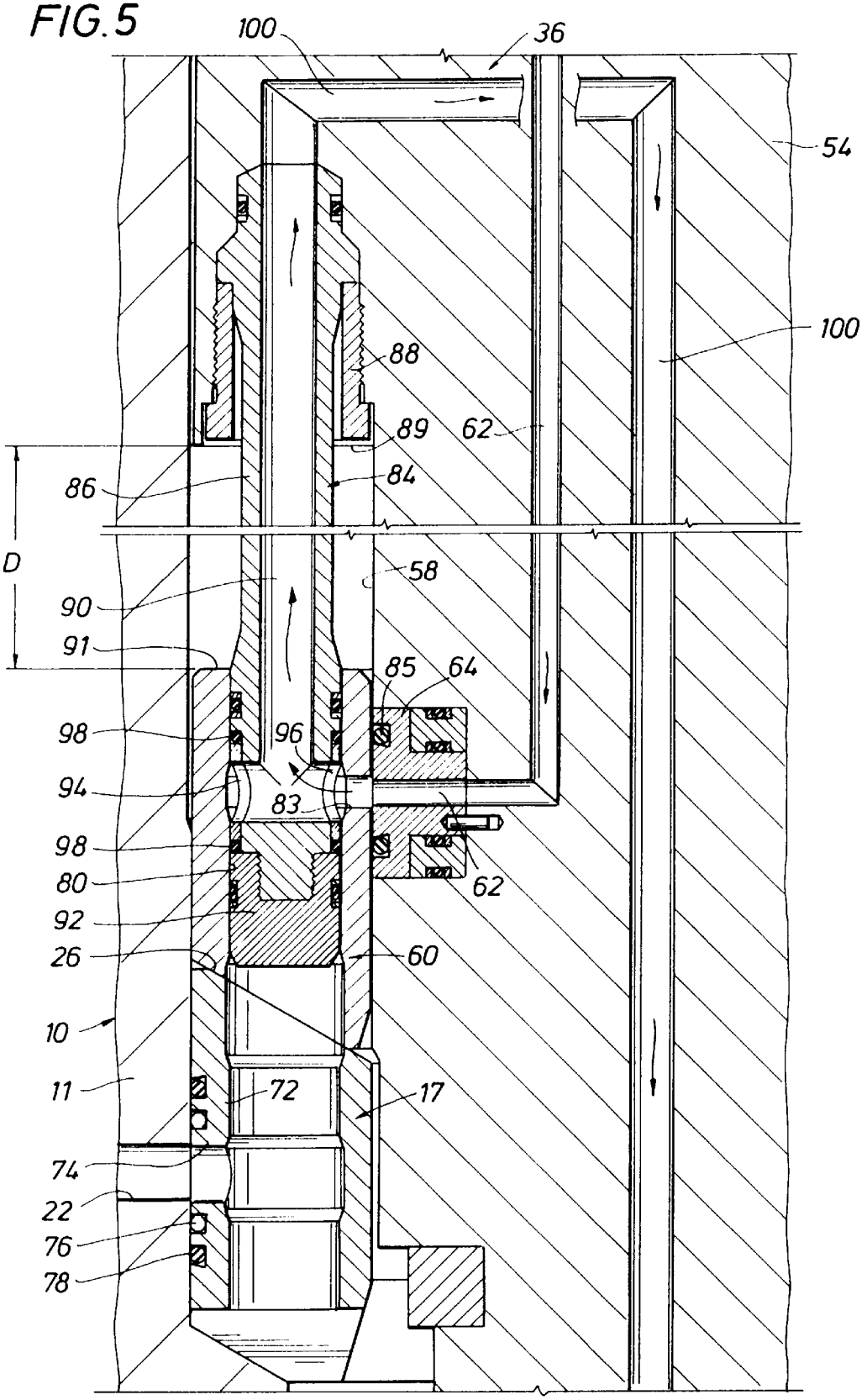
FIG. 5 is an enlarged sectional view of the fluid coupling between the tubing hanger and the wellhead member showing the tubing hanger before being completely landed on the wellhead member with hydraulic control fluid being supplied from the running tool to the tubing hanger.
Figure 6:
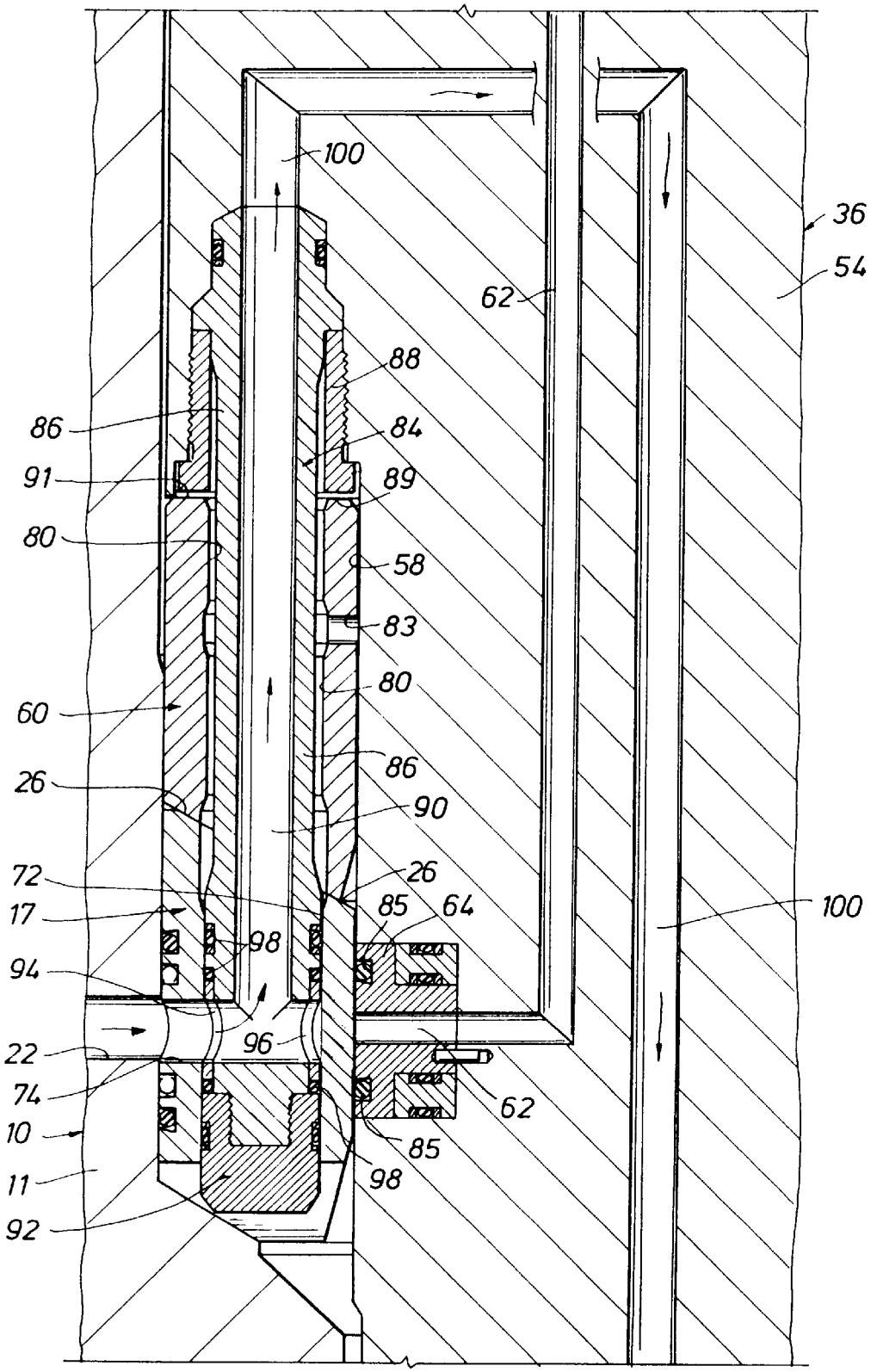
FIG. 6 is an enlarged sectional view of the fluid coupling shown in FIG. 5 after the tubing hanger is landed on the wellhead member with hydraulic control fluid being supplied to the tubing hanger from the wellhead member.

Referring now particularly to FIGS. 5 and 6, the hydraulic control fluid coupling between tubing hanger 36 and wellhead member 11 is illustrated. FIG. 5 shows the control fluid coupling when running tool 30 is connected to tubing hanger 36 and is lowering hanger 36 within the well. Sleeve 46 on running tool 36 is initially landed on shoulder 24 as shown in FIG. 1B prior to movement of running tool 30 and tubing hanger 36 relative to sleeve 46. FIG. 6 shows tubing hanger 36 landed on shoulder 26 of wellhead member 11 with running tool 30 released from engagement with tubing hanger 36. Fixed ring 17 has a plurality of axial openings 72 and a lateral port 74 for each opening 72 provides fluid communication with hydraulic control fluid passage 22 in wellhead housing or spool 11. An inner metal ring 76 and an outer sealing rings 78 provide seals for sealing about port 74.

Figure 2:
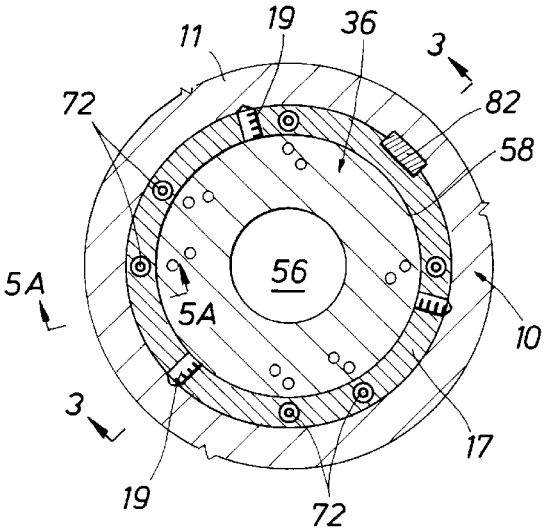
FIG. 2 is a sectional view taken generally along line 2—2 of FIG. 1B and showing a fixed wellhead ring permanently secured to the wellhead for landing of the tubing hanger on the wellhead and forming a portion of the fluid coupling between the tubing hanger and the wellhead member.
Figure 3:
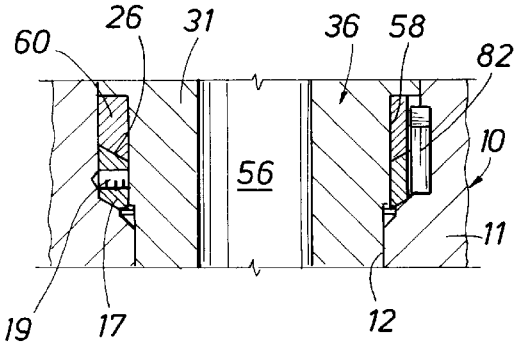
FIG. 3 is a section taken along line 3—3 of FIG. 2 and showing the tubing hanger landed on the fixed wellhead ring of the wellhead member with a slidable ring on the tubing hanger in mating landed engagement with the fixed ring of the wellhead member.

Upper ring 60 mounted on tubing hanger 36 for slidable movement has an plurality of axial openings 80 in axial alignment with openings 72 when ring 60 is keyed to ring 17 by key 82 as shown in FIGS. 2 and 3. A side cross port 83 in ring 60 is in fluid communication with auxiliary flow passage 62 when running tool 30 is connected to tubing hanger 36 as shown in FIG. 5. An elastomeric O-ring 85 on fitting 64 seals about ports 62 and 83. Secured to tubing hanger 36 and projecting downwardly within recess 58 are a plurality of stab pin assemblies generally indicated at 84. Each stab pin assembly 84 include a stab pin 86 secured by an externally threaded retaining sleeve 88 threaded within an opening in body 54 of tubing hanger 36. Each stab pin 86 has an axially extending bore 90 with an end sleeve 92 threaded about the closed end of stab pin 86. A pair of opposed side or cross ports 94, 96 communicate with bore 90. Port 94 is aligned with port 74 in the landed position of tubing hanger 36 as shown in FIG. 6. Port 96 is in alignment with port 83 when tubing hanger 36 is being lowered within wellhead spool 11 as shown in FIG. 5. Sealing rings 98 extend about pin 86 for sealing ports 94 and 96. Bore 90 of stab pin 86 is in axial alignment with main flow passage 100 which extends to control fluid line 102 to a downhole control member, such as a downhole safety valve 104 as shown in FIG. 1B.

Tubing hanger 36 has an annular shoulder 89 which connects the upper annular end 91 of hanger ring 60 in landed position for transferring loads to landing shoulder 26 on wellhead ring 17. Upper slidable hanger ring 60 initially connects landing shoulder 26 of wellhead ring 17 after about ⅛ inch travel upon sleeve 46 first contacting supporting shoulder 24 and initial bleeding of fluid from chamber 50.

Figure 5A:
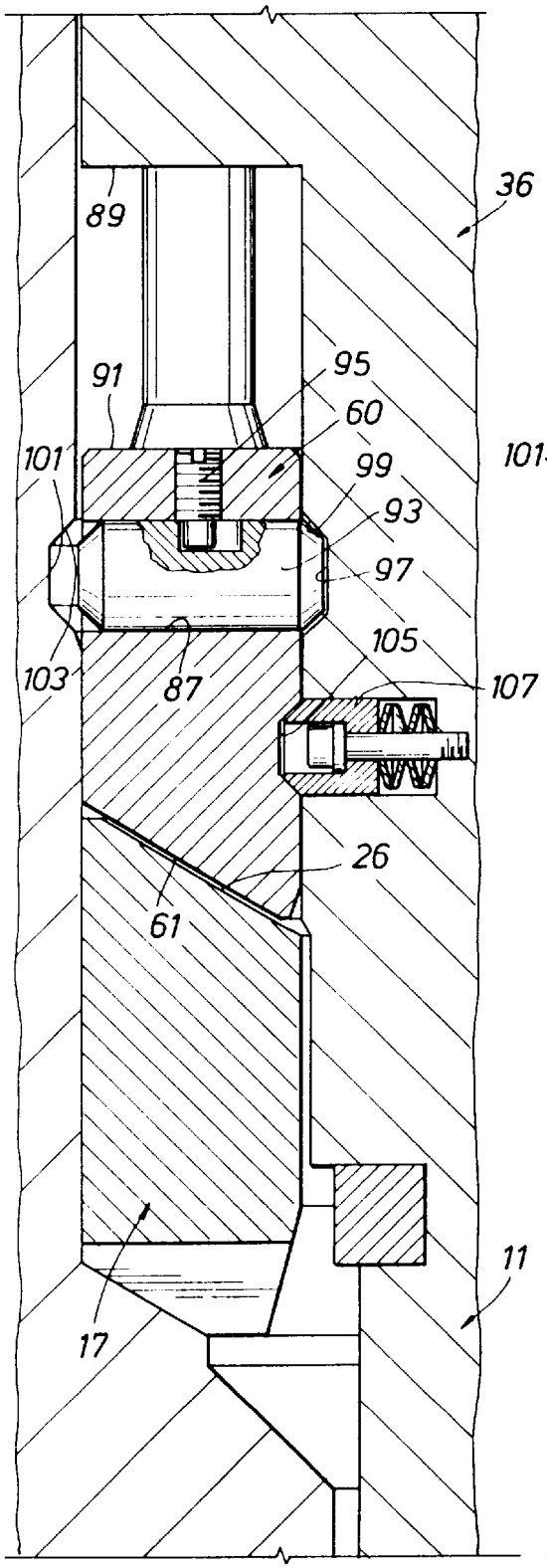
FIG. 5A is an enlarged section taken generally along line 5A—5A of FIG. 2 and showing means for releasably connecting the slidable tubing ring to the wellhead member prior to landing of the tubing hanger.
Figure 5B:
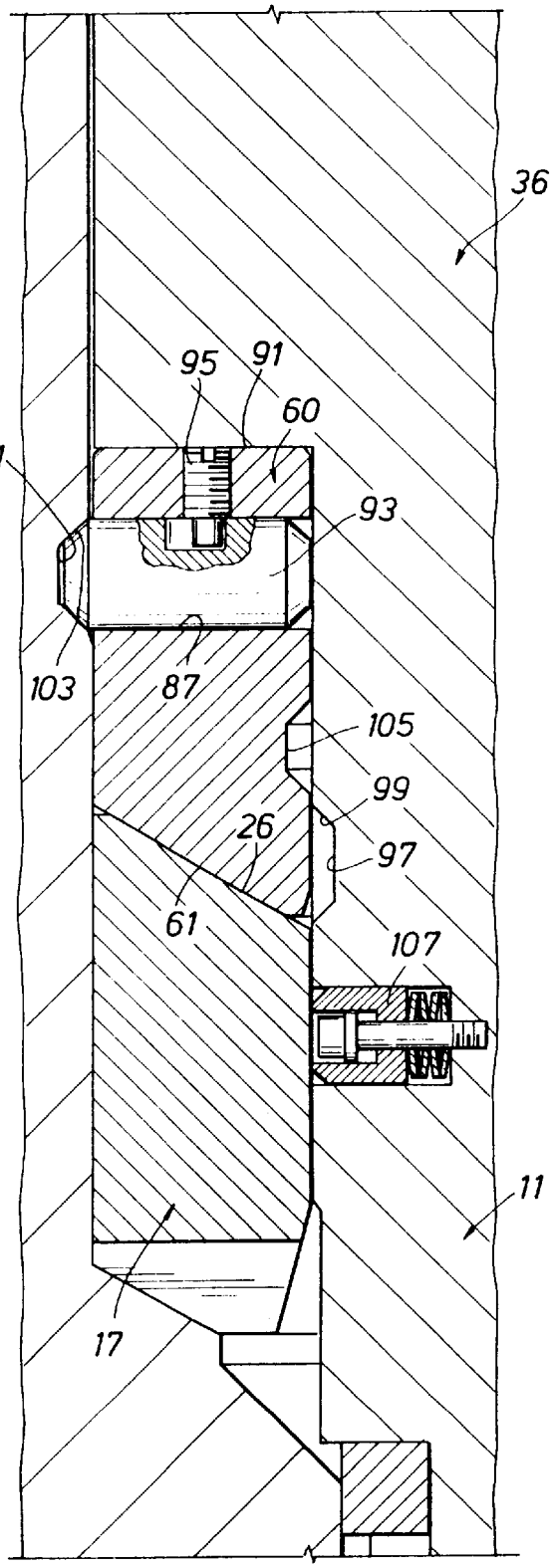
FIG. 5B is a section similar to FIG. 5A but showing the tubing hanger in a landed position on the wellhead member.

As shown particularly in FIGS. 5A and 5B, sliding hanger ring 60 has a plurality of openings or holes 87 therein and laterally slidable pins 93 are mounted in openings 87 for sliding movement. Keys 95 retain pins 93 within openings 87. An annular recess 97 in tubing hanger 36 adjacent pins 93 defines a cam surface 99. An annular groove 101 in wellhead member 11 adjacent pins 93 defines a cam surface 103. FIG. 5A shows the position of hanger ring 60 and tubing hanger 36 when sleeve 46 is approximately ⅛ inch from contacting supporting shoulder 24 on wellhead member 11 as shown in FIG. 1B. Upon bleeding of fluid from annular chamber 50 through line 42A as shown in FIG. 1B, tubing hanger moves downwardly distance D. Annular seat 61 on tubing ring 60 connects landing shoulder 26 after initial travel of tubing hanger 36 about ⅛ inch with pins 93 in transverse alignment with groove 101. Cam surface 99 then contacts pins 93 to cam pins 93 laterally into groove 101. Tubing hanger 36 then moves downwardly relative to tubing ring 60 and wellhead member 11 until lower seat 89 on tubing hanger 36 abuts end surface 91 of ring 60 as shown in FIGS. 5B and 6. A recess 105 is provided in ring 60 to receive a spring biased detent 107 carried by tubing hanger 36 to retain ring 60 to tubing hanger 36. Upon downward movement of tubing hanger 36 after ring 60 seats on wellhead ring 17, detent 107 is cammed out of recess 105.

For removal of tubing hanger 36 by running tool 30, tubing hanger 36 is lifted upwardly until recess 97 is in lateral alignment with pins 93. Then, cam surface 103 on wellhead member 11 cams pins 93 within openings 87 for retracting pins 93 and releasing tubing hanger 36 from wellhead member 11 for removal of tubing hanger 36. Also, detent 107 is received within recess 105 for effecting simultaneous movement of ring 60 with tubing hanger 36.

Operation of Embodiment of FIGS. 1–6

In operation, running tool 30 is connected to tubing hanger 36 for lowering tubing hanger 36 within the well for landing on wellhead housing or spool 11. Check valves 66 on tubing hanger 36 are opened by running tool 30 and control fluid is supplied by control fluid passage 42G and auxiliary control fluid passage 62 to aligned ports 83 and 96 to bore 90 in fluid communication with the main control fluid passage 100. Each main control fluid passage 100 may extend to a suitable downhole function such as a downhole safety valve 104 as shown in FIG. 1B. Thus, control fluid is supplied continuously to each downhole function for control thereof while tubing hanger 36 is being lowered by running tool 30.

Sleeve 46 of running tool 30 is landed on annular shoulder 24 of wellhead housing 11 to stop temporarily the downward movement of running tool 30 and tubing hanger 36 as shown in FIGS. 1A and 1B. Then, hydraulic control fluid is bled from annular chamber 50 as shown in FIG. 1A to permit relative downward movement of running tool 30 and tubing hanger 36 a distance D of around three and one half (3 ½) inches as shown also in FIG. 5 for downward movement of stab pin 86 from the position of FIG. 5 to the position of FIG. 6. Pins 93 are cammed into openings 87 upon downward movement of tubing hanger 36 to connect tubing hanger 36 to wellhead member 11 as shown in FIGS. 5A and 5B. Also, detent 107 is removed from recess 105.

As tubing hanger 36 and stab pin 86 move downwardly from the position of FIG. 5, auxiliary flow passage 62 is blocked by ring 17 and port 83 on slidable ring 60 is moved out of fluid communication with auxiliary flow passage 62. Thus, fluid communication between running tool 30 and tubing hanger 36 is stopped with O-ring 85 of fitting 64 sealing auxiliary fluid passage 62. Port 96 is also moved out of alignment with port 83 in ring 60 as ring 60 is supported on lower ring 17 fixed to wellhead structure 11.

When hanger shoulder 89 contacts the upper end 91 of hanger ring 60 as shown in FIG. 6, ports 74 and 94 are in fluid communication with each other and with axial bore 90 of pin 86. Control fluid is thus supplied to the main control fluid passage 100 from wellhead housing 11 through fluid passage 22, and ports 74 and 94 to main flow passage 100. Now, running tool 30 may be released from engagement with tubing hanger 36 by unlatching of latches 32, 34. As auxiliary flow passage 62 was blocked and a new main flow passage was established prior to the release of running tool 30, even if leakage occurs about check valve 66 or fitting 64, the newly established control fluid passage through passages 22 and 100 would not be contaminated by well fluids because these passages contain their own primary seal barriers formed by seal rings 76, 78 and 98.

If desired to remove tubing hanger 36 at a later date, running tool 30 may be easily reconnected to tubing hanger 36 and tubing hanger 36 lifted from engagement with wellhead housing 11. Upon lifting of tubing hanger 36, pins 93 are aligned laterally with groove 97 and are cammed by surface 103 in groove 101 of wellhead member 11 into recess 97 of hanger 36 to permit removal of tubing hanger 36 as shown particularly in FIGS. 5A and 5B. This re-establishes the auxiliary circuit between running tool 30 and hanger 36 and dis-engages the main circuit between the hanger 36 and wellhead member 11.

Figure 9:
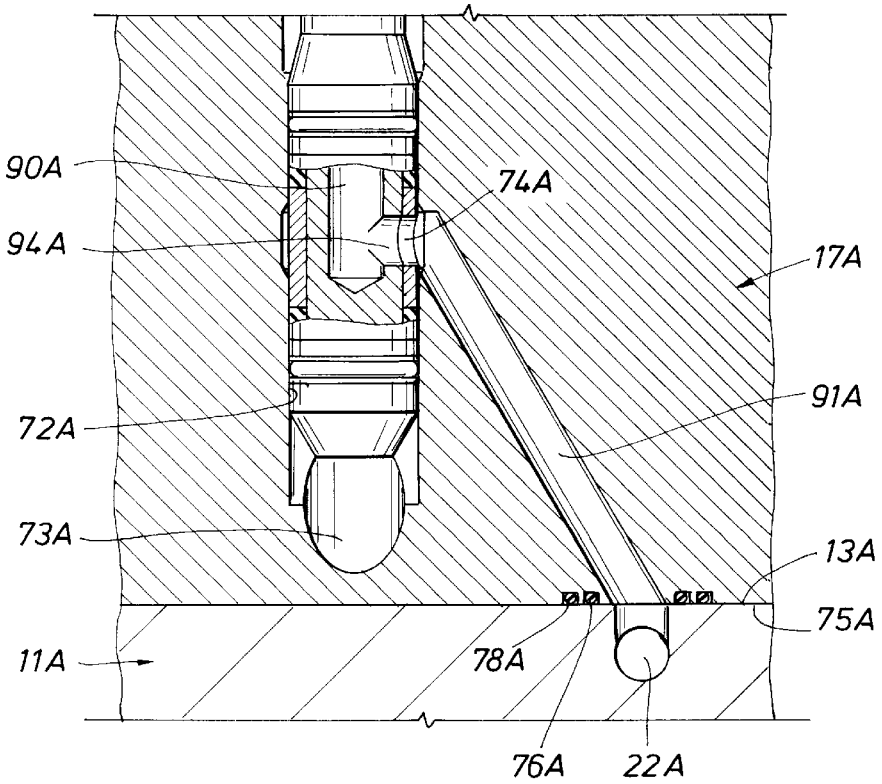
Figure 7:
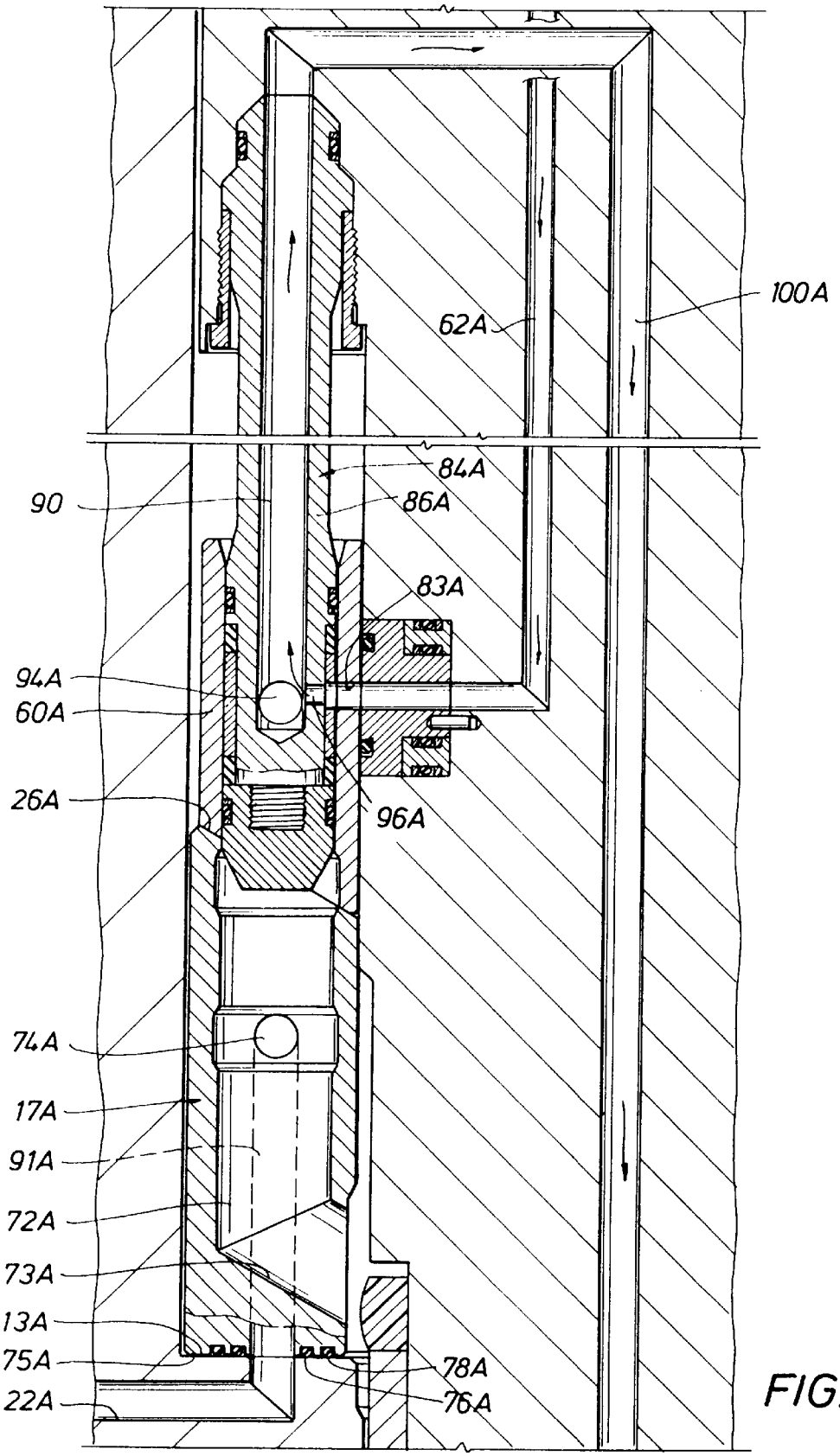
FIG. 7 is a sectional view of a modified fluid coupling or connector between the tubing hanger and sliding attached ring and a different sealing arrangement between the wellhead body and the wellhead ring and showing the hydraulic fluid being supplied from the running tool to the tubing hanger prior to the landing of the tubing hanger on the wellhead member.
Figure 8:
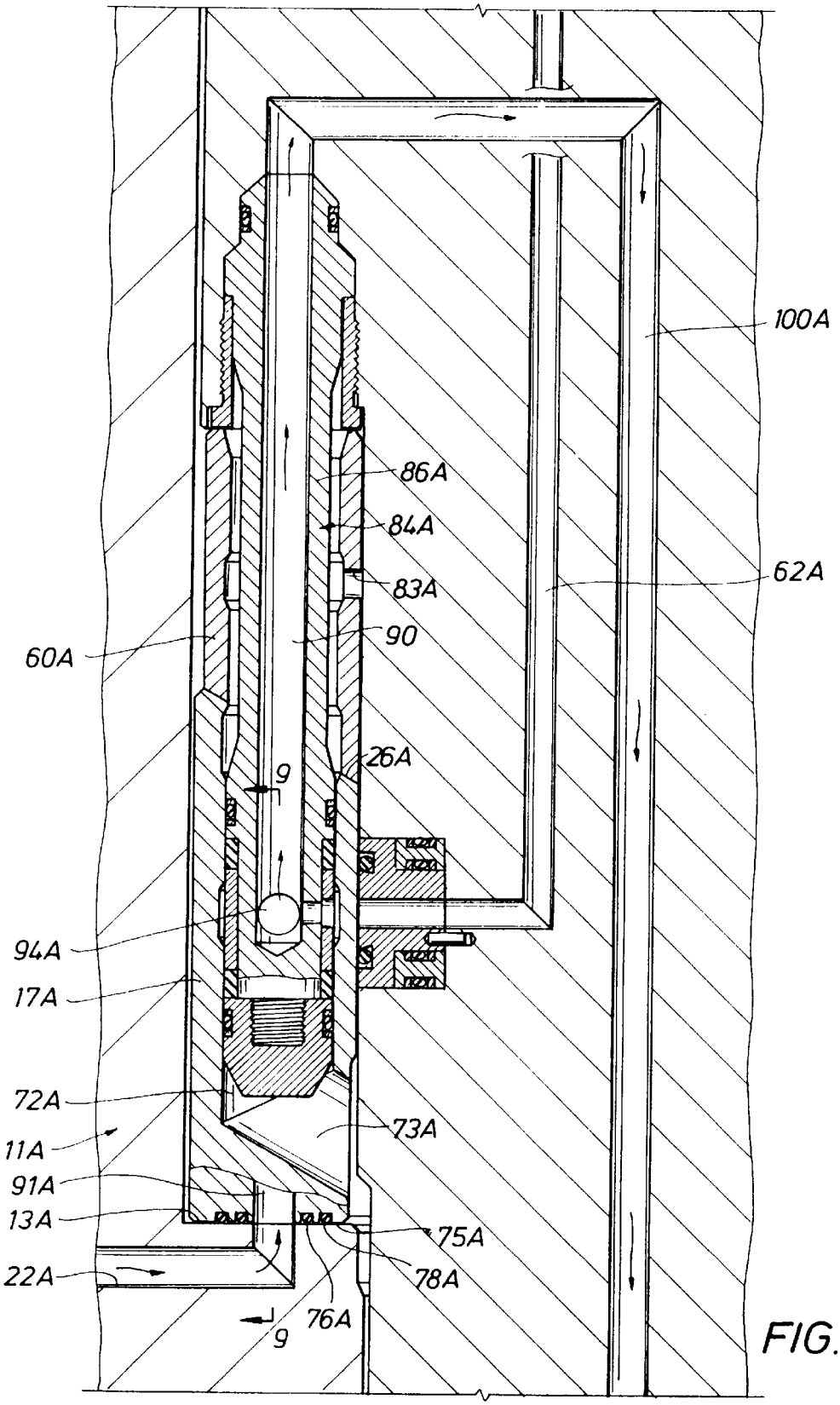
FIG. 8 is a sectional view of the modified fluid coupling shown in FIG. 7 but showing the tubing hanger landed on the wellhead member with hydraulic fluid being supplied from the wellhead member to the tubing hanger; and, FIG. 9 is a section taken along line 9—9 of FIG. 8 and showing the hydraulic fluid supply passage in the wellhead member in fluid communication with the main fluid passage in the stab pin of the tubing hanger to the downhole control member.

Embodiment of FIGS. 7–9

The embodiment shown in FIG. 7–9 provides a different sealing arrangement between wellhead body 11A and ring 17A fixed to wellhead body 11A. Also, the control fluid passaging between wellhead fluid passage 22A and the axial bore 90A of stab pin 84A has been changed to facilitate the different sealing arrangement.

As shown in FIG. 7–9, stab pin assembly 84A has a stab pin 86A received within slidable ring 60A. A wellhead ring 17A is fixed to the wellhead body 11A and has an upper landing shoulder 26A. A lateral port 83A in ring 60A is aligned with port 96A in stab pin 86A when tubing hanger 36A is connected to the running tool and being lowered within the well as shown in FIG. 7 in which auxiliary fluid passage 62A is in fluid communication with main flow passage 100A.

Wellhead body 11A has a planar horizontal shoulder 13A. Ring 17A has a plurality of axial openings 72A therein which do not extend through the entire height of ring 17A as in the embodiment of FIGS. 1–7 but are angled inwardly at 73A. A planar bottom surface 75A of ring 17A contacts shoulder 13A along its entire lower circular periphery. Sealing rings 76A and 78A between planar surfaces 13A and 75A on wellhead member 11A and wellhead ring 17A provide effective sealing about control fluid passage 22A from wellhead member 11A. A cross port 94A in stab pin 86A communicates with bore 90A in stab pin 86A and with branch control fluid passage or port 91A in ring 17A. An effective and highly reliable sealing arrangement is provided for the communication of port 91A in ring 17A to fluid passage or port 22A in wellhead body 11A, particularly in the landed position of tubing hanger 36A. The operation of the embodiment of FIGS. 7–9 is similar to the operation of the embodiment of FIGS. 1–6.

While the embodiments shows in the drawings illustrate fluid circuitry for hydraulic control fluid, it is understood that this invention would also be applicable for the injection of chemical fluids, such as methanol or chemical inhibitors which are utilized downhole for product treatment.

While preferred embodiments of the invention have been shown and described, modifications thereof can be made by one skilled in the art without departing from the spirit of the invention.

What is claimed is:

1. A wellhead assembly comprising:

a fixed wellhead member having an upper supporting shoulder and a lower landing shoulder;

a running tool having means for contacting said upper supporting shoulder for temporary landing of said running tool thereon;

a tubing hanger releasably connected to said running tool for lowering within said wellhead member;

first fluid coupling means between said tubing hanger and said running tool;

second fluid coupling means between said tubing hanger and said wellhead member;

said first fluid coupling means permitting the supply of fluid to said tubing hanger from said running tool while said tubing hanger is being lowered within said wellhead member and while said running tool is temporarily landed on said upper supporting shoulder;

means permitting downward movement of said tubing hanger into landed position on said lower landing shoulder after said running tool is landed on said upper landing shoulder; said second fluid coupling means being activated when said tubing hanger is landed on said lower shoulder to provide the supply of fluid from said wellhead member to said tubing hanger; and means to block the supply of fluid from said running tool to said tubing hanger when said tubing hanger moves downward from the temporary landed position of said running tool on said upper supporting shoulder.

2. A wellhead assembly as set forth in claim 1 wherein said means permitting downward movement of said tubing hanger after temporary landing of said running tool comprises an outer sleeve on said running tool which is supported on said upper supporting shoulder, said running tool having an inner body connected to said tubing hanger and moving downwardly with said tubing hanger relative to said sleeve for landing of said tubing hanger onto said lower landing shoulder of said wellhead member.

3. Well completion apparatus comprising:

a wellhead member:

a running tool;

a tubing hanger releasably connected to said running tool for being lowered within the wellhead member for landing;

a main fluid passage from said tubing hanger to supply fluid for a predetermined downhole function;

a fluid supply passage in said tubing hanger from said running tool and a separate fluid supply passage from said wellhead member to said tubing hanger;

fluid coupling means providing the supply of fluid to said tubing hanger from said fluid supply passage in said running tool during lowering of said tubing hanger within said wellhead member, and providing the supply of fluid to said tubing hanger from said separate fluid supply passage from said wellhead member when said tubing hanger is landed within said wellhead member; and means to block the supply of fluid to said tubing hanger from said running tool when said tubing hanger is landed within said wellhead member.

4. Well completion apparatus as set in claim 3 wherein said fluid coupling means includes said means to block the supply of fluid to said tubing hanger from said running tool when said tubing hanger is landed within said wellhead member.

5. Well completion apparatus as set forth in claim 3 wherein said fluid coupling means includes including a plurality of stab pins carried by said tubing hanger each stab pin having a fluid passage therein defining at least a portion of the main fluid passage to said downhole function.

6. Well completion apparatus as set forth in claim 3 wherein said fluid coupling means include:

a wellhead ring secured to the inner periphery of said wellhead member and having an axially extending opening therein; and a stabbing pin carried by said tubing hanger and received within said axially extending opening when said tubing hanger is landed within said wellhead member, said stabbing pin having an axial flow passage defining said fluid passage.

7. Well completion apparatus as set forth in claim 6 wherein said wellhead ring has a lateral port therein in fluid communication with said axial fluid passage in said stabbing pin in the landed position of said tubing hanger.

8. Well completion apparatus has set forth in claim 6 wherein a tubing hanger ring is mounted on the outer periphery of said tubing hanger and has an axial opening therein receiving said stabbing pin and in axial alignment with said axially extending opening in said wellhead ring.

9. Apparatus for transferring the supply of fluid to a tubing hanger from a running tool to a wellhead member after landing of the tubing hanger on the wellhead member; said apparatus comprising:

a stabbing pin carried by said tubing hanger, said stabbing pin having an axially extending flow passage and a lateral fluid port communicating with said axially extending flow passage;

an axially aligned opening in said wellhead member to receive said stabbing pin in mating relation and a lateral port extending from said opening;

a fluid passage in said tubing hanger extending to a selected downhole function and in fluid communication with said lateral port in said stabbing pin; and a fluid supply passage in the running tool and a separate fluid supply passage in the wellhead member;

said stabbing pin movable during landing of said tubing hanger on said wellhead member between a position in which the lateral port of said stabbing pin is in fluid communication with the fluid supply passage in the running tool prior to landing and is in fluid communication with the hydraulic fluid supply passage in the wellhead member after landing thereby to transfer the supply of fluid to the tubing hanger from the fluid supply passage in the running tool to the fluid supply passage in the wellhead member;

said fluid supply passage in said running tool being blocked from communicating with said lateral port in the landed position of the tubing hanger, and said fluid supply passage in said wellhead member being blocked from communicating with said lateral port prior to landing of said tubing hanger within said wellhead.

10. Apparatus as set forth in claim 9 wherein:

a plurality of stabbing pins are carried by said tubing hanger and a plurality of axially aligned openings are provided in said wellhead member to receive such stabbing pins.

11. Apparatus as set forth in claim 10 wherein said tubing hanger has a body mounting said stabbing pins for relative axial movement, said body having a primary fluid passage extending from said stabbing pins to said selected downhole function.

12. Apparatus as set forth in claim 10 wherein a wellhead ring is fixed to the inner periphery of said wellhead member and has said plurality of axially aligned openings therein for receiving said stabbing pins.

13. Apparatus as set forth in claim 12 wherein a sleeve is mounted on said tubing hanger about each of said stabbing pins for sliding movement relative to said pins; said sleeve having a lateral port therein in fluid communication with said fluid supply passage in said running tool when said tubing hanger is being lowered within said wellhead member, said lateral port in said sleeve being blocked from fluid communication with said fluid supply passage in said running tool when said tubing hanger is landed on said wellhead member.

14. Apparatus for transferring the supply of fluid to a tubing hanger from a tubing hanger running tool to a wellhead member after landing of the tubing hanger on said wellhead member; said apparatus comprising:

a fluid passage in said tubing hanger in fluid communication with a selected downhole function;

a first fluid supply passage in said running tool in fluid communication with said fluid passage in said tubing hanger during lowering of said tubing hanger within said wellhead member to supply fluid to said selected downhole function prior to landing of the tubing hanger on the wellhead member;

a second fluid supply passage in said wellhead member in fluid communication with said fluid passage in said tubing hanger to said selected downhole function when said tubing hanger is landed on said wellhead member; and means blocking fluid communication between the fluid passages of said running tool and said tubing hanger to said selected downhole function when said tubing hanger is landed on said wellhead member thereby to transfer the supply of fluid to said tubing hanger from said running tool to said wellhead member.

15. Apparatus as set forth in claim 14 wherein a wellhead ring is secured to the inner periphery of said wellhead member and has a fluid passage therein forming a continuation of said second fluid supply passage in said wellhead member, said wellhead ring fluid passage and said second fluid supply passage forming opposed ports in adjacent contacting surfaces of said wellhead ring and said wellhead member, and annular seals about said ports for sealing between said contacting surfaces.

16. Apparatus as set forth in claim 15 wherein said contacting surfaces are planar surfaces.

17. Apparatus as set forth in claim 15 wherein said contacting surfaces are cylindrical surfaces.

18. Apparatus as set forth in claim 14 wherein:

fluid connection means are provided between said wellhead member and said tubing hanger, said connection means providing fluid communication between said second fluid supply passage in said wellhead member and said fluid passage in said tubing hanger in the landed position of said tubing hanger.

19. Apparatus as set forth in claim 18 wherein said fluid connection means includes an axially extending stabbing pin carried by said tubing hanger and having an axially extending flow passage and a lateral port communicating with said flow passage;

said wellhead member having an axially extending opening for receiving said stabbing pin in mating relation and a lateral port communicating with said axially extending opening;

said lateral ports in said stabbing pins and said wellhead member being in fluid communication with each other in the landed position of said tubing hanger for the supply of fluid to said selected control member and being out of fluid communication with each other when said tubing hanger is not landed within said wellhead member.

20. A method of supplying fluid downhole in a well for selected downhole functions through a fluid conduit in a tubing hanger, the fluid being supplied to a selected downhole function in the well from a running tool during lowering of the tubing hanger and from a wellhead member after seating of the tubing hanger on the wellhead member; said method comprising the following steps:

supplying fluid for selected downhole functions from said running tool to said tubing hanger and said fluid conduit therein during lowering of said hanger within the wellhead member by the running tool;

supplying fluid from said wellhead member to said hanger and said fluid conduit therein upon seating of said tubing hanger for providing fluid to the selected downhole function in the well; and blocking the supply of fluid to said tubing hanger from said running tool upon seating of said tubing hanger on said wellhead member.

21. The method as set forth in claim 20 including the step of:

providing a connector on said tubing hanger to block fluid communication between said wellhead member and said fluid conduit in said tubing hanger when said tubing hanger is not seated within said wellhead member, and to permit fluid communication between said wellhead member and said fluid conduit in said tubing hanger when said tubing hanger is seated within said wellhead member.

* * * * *